US010233859B2

(12) United States Patent
Ikeuchi

(10) Patent No.: US 10,233,859 B2
(45) Date of Patent: Mar. 19, 2019

(54) FUEL INJECTION CONTROL DEVICE AND FUEL INJECTION CONTROL METHOD FOR INTERNAL COMBUSTION ENGINE

(71) Applicant: NISSAN MOTOR CO., LTD., Yokohama-shi, Kanagawa (JP)

(72) Inventor: Takanobu Ikeuchi, Kanagawa (JP)

(73) Assignee: NISSAN MOTOR CO., LTD., Yokohama-shi, Kanagawa (JP)

( * ) Notice: Subject to any disclaimer, the term of this patent is extended or adjusted under 35 U.S.C. 154(b) by 0 days.

(21) Appl. No.: 15/504,806

(22) PCT Filed: Aug. 21, 2014

(86) PCT No.: PCT/JP2014/071926
§ 371 (c)(1),
(2) Date: Feb. 17, 2017

(87) PCT Pub. No.: WO2016/027354
PCT Pub. Date: Feb. 25, 2016

(65) Prior Publication Data

US 2017/0260925 A1 Sep. 14, 2017

(51) Int. Cl.

| | |
|---|---|
| ***F02D 41/30*** | (2006.01) |
| ***F02D 41/22*** | (2006.01) |
| ***F02D 41/34*** | (2006.01) |
| ***F02D 45/00*** | (2006.01) |
| ***F02D 41/40*** | (2006.01) |

(Continued)

(52) U.S. Cl.
CPC ..... *F02D 41/3094* (2013.01); *F02D 41/047* (2013.01); *F02D 41/22* (2013.01); *F02D 41/34* (2013.01); *F02D 41/3836* (2013.01); *F02D 41/402* (2013.01); *F02D 45/00* (2013.01);

(Continued)

(58) Field of Classification Search
CPC .... F02D 41/3094–41/405; F02D 17/02; F02D 2200/10; F02D 2200/101; F02D 2200/602; F02D 41/123–41/126; F02M 63/024; F02M 63/0245; F02M 63/026
USPC ..... 701/104, 112; 123/198 F, 299–300, 445, 123/495, 510, 511
See application file for complete search history.

(56) References Cited

U.S. PATENT DOCUMENTS 5,983,857 A 11/1999 Mamiya et al.
6,694,945 B2 * 2/2004 Kawaguchi ..... F02D 41/0085 123/299

(Continued)

FOREIGN PATENT DOCUMENTS

EP 1 753 953 A1 2/2007
EP 1 896 711 A1 3/2008

(Continued)

*Primary Examiner* — Lindsay M Low
*Assistant Examiner* — Robert A Werner
(74) *Attorney, Agent, or Firm* — Drinker Biddle & Reath LLP

(57) ABSTRACT

An internal combustion engine includes a port injector that injects fuel into an intake port and a direct injection injector that injects fuel directly into a combustion chamber. When the internal combustion engine is in a low load condition while requiring fuel injection, a controller stops fuel injection through the port injector so that an entire required fuel injection amount is injected through the direct injection injector. As a result of this processing, the fuel pressure of the direct injection injector is reduced quickly in the low load condition.

2 Claims, 6 Drawing Sheets

(51) Int. Cl.
*F02D 41/04* (2006.01)
*F02D 41/38* (2006.01)
*F02D 41/12* (2006.01)

(52) U.S. Cl.
CPC ..... *F02D 41/12* (2013.01); *F02D 41/123* (2013.01); *F02D 41/221* (2013.01); *F02D 2200/10* (2013.01)

(56) References Cited

U.S. PATENT DOCUMENTS 7,331,328 B2 * 2/2008 Mashiki ..... F02D 41/406 123/299
7,497,210 B2 * 3/2009 Okamoto ..... F02D 13/06 123/673
7,720,591 B2 * 5/2010 Takamiya ..... F01L 1/34 123/399
7,953,529 B2 * 5/2011 Takamiya ..... F01L 1/34 701/103
7,992,539 B2 * 8/2011 Ikoma ..... F02D 41/08 123/299
2007/0000478 A1 * 1/2007 Sadakane ..... F02D 41/38 123/431
2007/0044767 A1 * 3/2007 Kojima ..... F02M 53/043 123/470
2012/0247422 A1 10/2012 Nagakura
2013/0226437 A1 8/2013 Kato et al.

FOREIGN PATENT DOCUMENTS

EP 1 899 594 A1 3/2008
JP H10-227241 A 8/1998
JP 2001-248505 A 9/2001
JP 2007-064131 A 3/2007
JP 2007-239487 A 9/2007
JP 2009-281157 A 12/2009
JP 2012-149555 A 8/2012
JP 2012-219622 A 11/2012
WO WO 2013/076561 A2 5/2013
WO WO 2014/020393 A1 2/2014

* cited by examiner

FUEL INJECTION CONTROL DEVICE AND FUEL INJECTION CONTROL METHOD FOR INTERNAL COMBUSTION ENGINE

TECHNICAL FIELD

The present invention relates to fuel injection control implemented on an internal combustion engine having a port injector that injects fuel into an intake port and a direct injection injector that injects fuel directly into a combustion chamber.

BACKGROUND ART

JP2007-064131A, published by the Japan Patent Office, proposes fuel injection control implemented on a dual injection internal combustion engine having a port injector that injects fuel into an intake port and a direct injection injector that injects fuel directly into a combustion chamber. A dual injection internal combustion engine is applied to an internal combustion engine that requires a particularly high output such that a required amount of fuel cannot be supplied merely by injecting fuel into the combustion chamber through the direct injection injector.

In the fuel injection control according to the prior art, when a fuel cut condition is established in the internal combustion engine, fuel injection by the port injector is stopped first, whereupon fuel injection by the direct injection injector is stopped. The reason for this is as follows.

A part of the fuel injected into the intake port by the port injector adheres to a wall surface and so on of the port. The fuel adhered to the wall surface of the port takes a longer time to reach the combustion chamber than the fuel that flows into the combustion chamber without adhering to the wall surface of the port. When injection by the port injector and injection by the direct injection injector are stopped simultaneously upon establishment of the fuel cut condition, combustion by the internal combustion engine stops at that point. Since the fuel adhered to the wall surface and so on of the port reaches the combustion chamber at a delay, however, combustion may already have stopped at the point where this fuel reaches the combustion chamber. When the fuel that reaches the combustion chamber after combustion has stopped is discharged as unburned fuel, an exhaust gas composition inevitably deteriorates.

In the prior art, injection by the direct injection injector is continued for a fixed period following establishment of the fuel cut condition so that fuel combustion in the combustion chamber is maintained until the fuel adhered to the wall surface and so on of the port after being injected by the port injector reaches the combustion chamber at a delay. As a result, the fuel that reaches the combustion chamber at a delay is burned reliably.

SUMMARY OF INVENTION

In the prior art, the fuel injection control described above is implemented only when the fuel cut condition is established. In other cases, the port injector and the direct injection injector perform fuel injection at a predetermined allocation rate. Typically, the direct injection injector is set at a higher fuel pressure than the port injector.

However, a fuel injection amount required when the internal combustion engine is at a low load, for example during idling, is small. When both the port injector and the direct injection injector perform fuel injection in a low load condition, the fuel pressure of the direct injection injector cannot easily be reduced.

When the fuel pressure remains high in the low load condition, variation is likely to occur in the injection amount of the direct injection injector. It is therefore desirable to reduce the fuel pressure of the direct injection injector as quickly as possible in the low load condition. In the fuel injection control according to the prior art, however, until the fuel cut condition is established, fuel injection is performed by both the port injector and the direct injection injector in the low load condition, making it difficult to reduce the fuel pressure of the direct injection injector quickly.

It is therefore an object of the present invention to reduce the fuel pressure of a direct injection injector efficiently in a low load condition before arriving at a fuel cut condition.

To achieve the above object, the present invention provides a fuel injection control device for an internal combustion engine having a port injector that injects fuel into an intake port and a direct injection injector that injects fuel directly into a combustion chamber.

According to an aspect of the present invention, the fuel injection control device includes a load detection sensor that detects a load of the internal combustion engine, and a programmable controller that controls fuel injection in accordance with the load. The controller is programmed to determine whether or not the internal combustion engine is in a load condition and whether or not the internal combustion engine requires fuel injection, and when the internal combustion engine is in the low load condition while requiring fuel injection, to stop fuel injection through the port injector and cause the direct injection injector to inject an entire fuel injection amount required by the internal combustion engine.

The details as well as other features and advantages of this invention are set forth in the remainder of the specification and are shown in the accompanying drawings.

DESCRIPTION OF EMBODIMENTS

Figure 1:
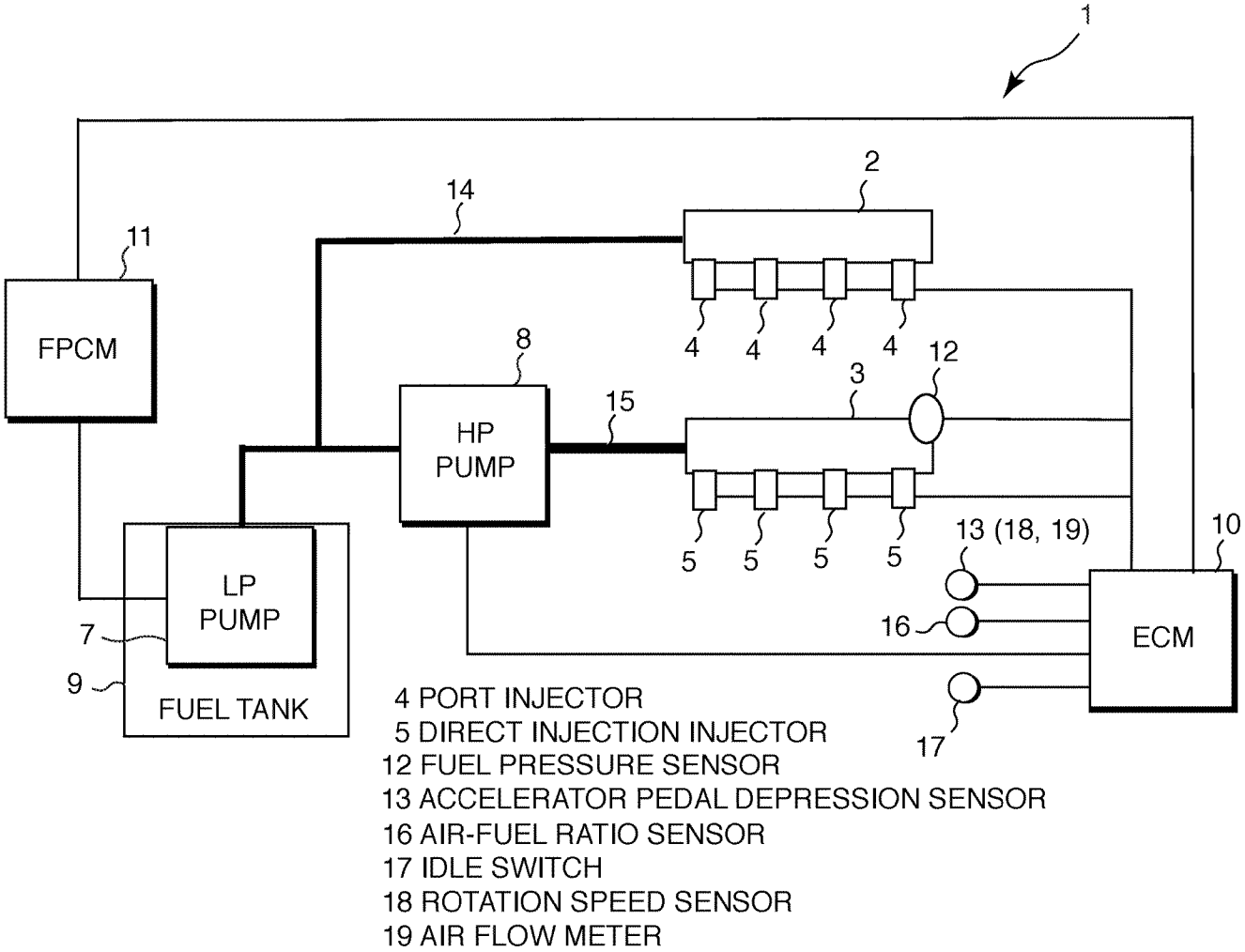
FIG. 1 is a schematic diagram showing a configuration of a fuel injection control device for an internal combustion engine according to the present invention.

Referring to FIG. 1 of the drawings, a fuel injection control device 1 according to a first embodiment of the present invention is applied to a multi-cylinder internal combustion engine for a vehicle. The internal combustion engine is a dual injection internal combustion engine having port injectors 4 for injecting fuel into intake ports of respective cylinders, and direct injection injectors 5 for injecting fuel directly into combustion chambers of the respective cylinders. In the internal combustion engine, an air-fuel mixture constituted by desired amounts of intake air and fuel is generated by injecting fuel into intake air in the intake port through the port injectors 4, and injecting more fuel through the direct injection injectors 5 into an air-fuel mixture of injected fuel and air that have been drawn into the combustion chamber. The air-fuel mixture is then burned by spark ignition.

The port injectors 4 inject fuel separately into the respective cylinders using a method known as multipoint injection (MPI). The port injectors 4 are connected to a shared MPI fuel tube 2 so as to inject fuel at a fuel pressure of the MPI fuel tube 2. Fuel injection by the port injectors 4 will be referred to hereafter as MPI injection.

The direct injection injectors 5 inject fuel directly into the respective combustion chambers using a method known as gasoline direct injection (GDI). The direct injection injectors 5 are connected to a shared GDI fuel tube 3 so as to inject fuel at a fuel pressure of the GDI fuel tube 3. Fuel injection by the direct injection injectors 5 will be referred to hereafter as GDI injection.

Fuel is supplied to the MPI fuel tube 2 from a low-pressure fuel pump 7 through a low-pressure hose 14. The low-pressure fuel pump 7 is either driven mechanically by the internal combustion engine or driven by an electric motor. The low-pressure fuel pump 7 draws and pressurizes fuel from a fuel tank 9, and supplies the pressurized fuel to the MPI fuel tube 2 and a high-pressure fuel pump 8 through the low-pressure hose 14.

The high-pressure fuel pump 8 is either driven mechanically by the internal combustion engine or driven by an electric motor. The high-pressure fuel pump 8 further pressurizes the fuel supplied thereto from the low-pressure fuel pump 7 through the low-pressure hose 14, and supplies the pressurized fuel to the GDI fuel tube 3 through a high-pressure sub-tube 15.

An engine control module (ECM) 10 controls a fuel injection amount and an injection timing of the respective port injectors 4, and a fuel injection amount and an injection timing of the respective direct injection injectors 5. More specifically, the port injectors 4 and the direct injection injectors 5 inject fuel for periods and at timings corresponding to pulse width signals output by the ECM 10 via signal circuits.

The ECM 10 also controls an operation of the high-pressure fuel pump 8. For this control, a fuel pressure sensor 12 that detects the fuel pressure in the GDI fuel tube 3 is connected to the ECM 10 via a signal circuit. The ECM 10 controls the operation of the high-pressure fuel pump 8 on the basis of the fuel pressure in the GDI fuel tube 3, detected by the fuel pressure sensor 12. It should be noted that when an engine load of the internal combustion engine is low, the operation of the high-pressure fuel pump 8 is stopped by means of conventional control.

The ECM 10 is constituted by a microcomputer having a central processing unit (a CPU), a read-only memory (a ROM), a random access memory (a RAM), and an input/output interface (an I/O interface). The ECM 10 may be constituted by a plurality of microcomputers.

An operation of the low-pressure fuel pump 7, meanwhile, is controlled by a fuel pump control module (FPCM) 11. The FPCM 11 is also constituted by a microcomputer having a central processing unit (a CPU), a read-only memory (a ROM), a random access memory (a RAM), and an input/output interface (an I/O interface). The FPCM 11 may also be constituted by a plurality of microcomputers. Alternatively, the ECM 10 and the FPCM 11 may be constituted by a single microcomputer.

An accelerator pedal depression sensor 13 that detects a depression amount of an accelerator pedal provided in the vehicle as the load of the internal combustion engine is connected to the ECM 10 by a signal circuit. Further, an air-fuel ratio sensor 16 that detects an air-fuel ratio of the air-fuel mixture burned in the combustion chamber from an oxygen concentration of exhaust gas discharged by the internal combustion engine is connected to the ECM 10 via a signal circuit. Furthermore, an idle switch 17 that remains OFF when the accelerator pedal is depressed and switches ON when the accelerator pedal is released is connected to the ECM 10 via a signal circuit.

Figure 2:
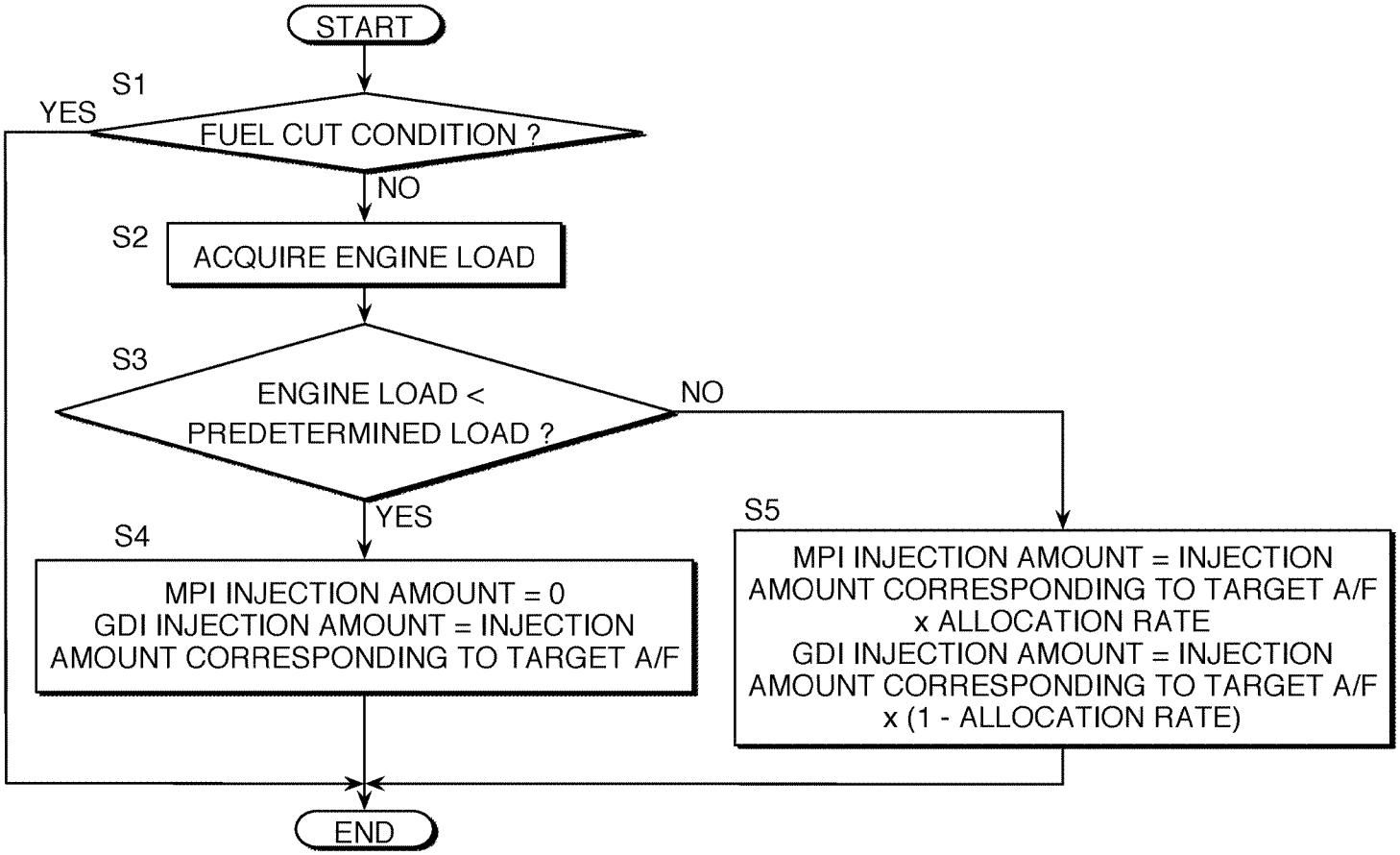
FIG. 2 is a flowchart illustrating a fuel injection control routine executed by an engine control module according to a first embodiment of the present invention.

The ECM 10 controls fuel injection by the port injectors 4 and fuel injection by the direct injection injectors 5 by executing a fuel injection control routine shown in FIG. 2 on the basis of the accelerator pedal depression amount. This routine is executed repeatedly at fixed time intervals of ten milliseconds, for example, while the internal combustion engine is operative.

Referring to FIG. 2, first, in a step S1, the ECM 10 determines whether or not a fuel cut condition is established. Here, a determination is made as to whether or not the internal combustion engine requires fuel injection. The determination as to whether or not the fuel cut condition is established may be performed using the following method, for example.

In a case where a fuel cut is performed on the internal combustion engine in a separate routine, the ECM 10 may determine from the separate routine whether or not a fuel cut has been executed, and may determine that the fuel condition is established when a fuel cut has been executed.

When the fuel cut condition is established in the step S1, the ECM 10 immediately terminates the routine.

When the fuel cut condition is not established in the step S1, this means that the internal combustion engine requires fuel injection.

In this case, the ECM 10 acquires the engine load in a step S2. Next, in a step S3, the ECM 10 determines whether or not the engine load is smaller than a predetermined load, or in other words whether or not the internal combustion engine is in a low load condition.

As regards the processing of the steps S2 and S3, in this embodiment, the accelerator pedal depression amount detected by the accelerator pedal depression sensor 13 is used as the engine load. When the accelerator pedal depression amount is zero, it is determined that the engine load is smaller than the predetermined load.

It should be noted, however, that various parameters other than the accelerator pedal depression amount may be used instead as the parameter for determining the engine load. For example, the engine load may be determined using a rotation speed, an intake air amount, or the fuel injection amount of the internal combustion engine.

More specifically, the engine load may be determined to be low when the rotation speed of the internal combustion engine detected by a rotation speed sensor 18 is equal to or lower than a predetermined speed or a reduction in the rotation speed of the internal combustion engine equals or exceeds a predetermined amount. Moreover, an output torque of the internal combustion engine is determined in accordance with the rotation speed, and therefore the output torque may be determined from the rotation speed by referring to a torque map, and the engine load may be determined to be low when the output torque is smaller than a predetermined torque.

The intake air amount of the internal combustion engine is controlled by a throttle that operates in conjunction with the accelerator pedal, and therefore the intake air amount, which is measured using an air flow meter 19, may be considered as a parameter expressing the engine load. Furthermore, the fuel injection amount is controlled relative to the intake air amount in order to realize a target air-fuel ratio, and therefore the fuel injection amount may also be considered as a parameter expressing the engine load.

Hence, the determinations of the steps S2 and S3 as to whether or not the engine load is low may be performed using various parameters. The engine rotation speed, the engine output torque, the intake air amount, and the fuel injection amount are all parameters that are closer to actual engine operating conditions than the accelerator pedal depression amount, and therefore the load condition of the internal combustion engine can be determined more precisely.

However, the parameters described above all vary on the basis of the accelerator pedal depression amount, and therefore the responsiveness of the fuel injection control can be maximized by employing the accelerator pedal depression amount as the engine load. Moreover, determining that the engine load is smaller than the predetermined load when the accelerator pedal depression amount is zero is substantially equivalent to recognizing that the accelerator pedal has been switched ON and OFF. Hence, adaptation processing does not have to be performed on the output signal from the accelerator pedal depression sensor 13, and therefore the fuel injection control device 1 can be packaged more easily. It should be noted that the idle switch 17 is also capable of determining that the accelerator pedal has been switched ON and OFF.

When it is determined in the step S3 that the internal combustion engine is in the low load condition, the ECM 10 advances to processing of a step S4.

More specifically, the ECM 10 sets an MPI injection amount, i.e. the fuel injection amount of the port injectors 4, at zero. Meanwhile, the ECM 10 sets a GDI injection amount, i.e. the fuel injection amount of the direct injection injectors 5, at a target fuel injection amount calculated from the target air-fuel ratio and the intake air amount. The processing of the step S4 corresponds to processing for stopping MPI injection by the port injectors 4 such that the entire fuel injection amount required by the internal combustion engine is injected through the direct injection injectors 5. The ECM 10 then executes fuel injection at the set injection amounts. Following the processing of the step S4, the ECM 10 terminates the routine.

When it is determined in the step S3 that the internal combustion engine is not in the low load condition, on the other hand, the ECM 10 advances to processing of a step S5.

More specifically, the ECM 10 sets the MPI injection amount at a value obtained by multiplying an allocation rate by a target fuel injection amount calculated from the target air-fuel ratio and the intake air amount. The allocation rate is a predetermined value that is used to determine a ratio of the MPI injection amount to the fuel injection amount required to achieve the target air-fuel ratio. The ECM 10 sets an amount obtained by subtracting the MPI injection amount from the target fuel injection amount as the DGI injection amount of the direct injection injectors 5. Following the processing of the step S5, the ECM 10 terminates the routine.

Next, referring to FIGS. 3A-3F, execution results of the fuel injection control routine will be described.

Figures 3A, 3B, 3C, 3D, 3E, 3F:
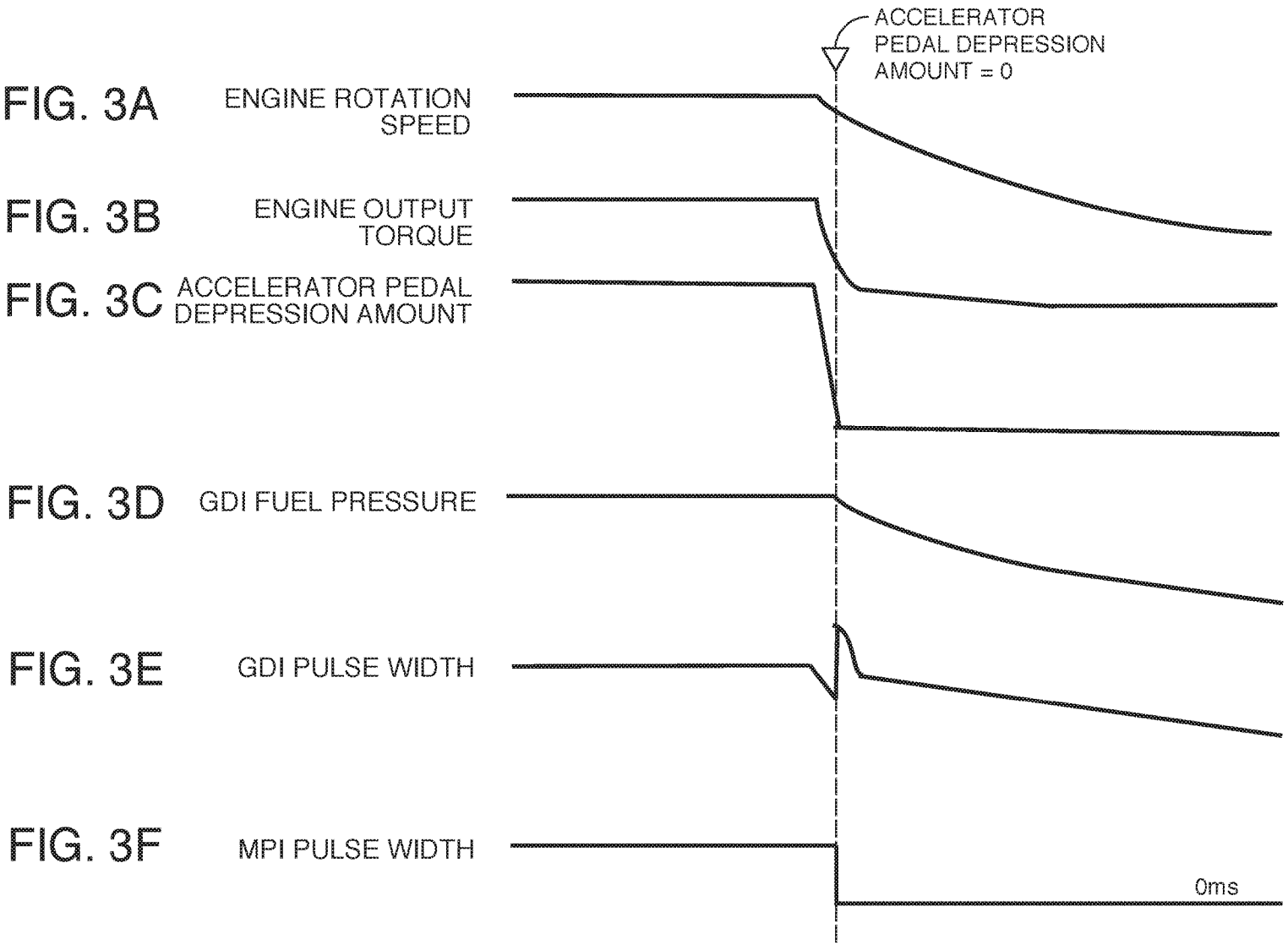
FIGS. 3A-3F are timing charts illustrating execution results of the fuel injection control routine.

As shown in FIG. 3C, when a driver of the vehicle removes his/her foot from the depressed accelerator pedal, the accelerator pedal depression amount decreases rapidly. The accelerator pedal depression amount reaches zero in a position indicated by a triangle mark in the figure.

As shown in FIG. 3A, the engine rotation speed starts to decrease at the same time as the accelerator pedal depression amount starts to decrease toward zero, but decreases more gently. As shown in FIG. 3B, the engine output torque varies in accordance with the accelerator pedal depression amount.

In the fuel injection control routine, meanwhile, the determination of the step S3 remains negative until the accelerator pedal depression amount falls below a predetermined amount. As a result, the ECM 10 executes MPI injection through the port injectors 4 and GDI injection through the direct injection injectors 5 at the predetermined allocation rate in the step S5 in order to achieve the target air-fuel ratio. A GDI pulse width in FIG. 3E corresponds to the GDI injection amount injected by the direct injection injectors 5. An MPI pulse width in FIG. 3F corresponds to the MPI injection amount injected by the port injectors 4.

When the accelerator pedal depression amount falls below the predetermined amount in the position indicated by the triangle mark in the figure, the determination of the step S3 changes from negative to affirmative. As a result, in the step S4, the MPI injection amount injected by the port injectors 4 is set at zero, and the GDI injection amount injected by the direct injection injectors 5 is set at the entire fuel injection amount required to achieve the target air-fuel ratio.

As shown in FIG. 3F, the MPI pulse width falls to zero at the same time as the determination of the step S3 becomes affirmative. Further, as shown in FIG. 3E, the GDI injection amount decreases in accordance with the reduction in the accelerator pedal depression amount before the determination of the step S3 becomes affirmative. At the same time as the determination of the step S3 becomes affirmative, however, the MPI injection amount injected up to that point by the port injectors 4 is added to the GDI injection amount, leading to a temporary increase in the GDI injection amount. Thereafter, since the accelerator pedal depression amount has fallen to zero, the GDI injection amount decreases toward a target fuel injection amount of an idling operation.

When the engine load decreases, the operation of the high-pressure fuel pump 8 is stopped. Therefore, as shown in FIG. 3D, the fuel pressure in the GDI fuel tube 3 decreases every time GDI injection is performed by the direct injection injectors 5. As a result, the direct injection injectors 5 execute fuel injection at a lower fuel pressure the next time the accelerator pedal is depressed. When the direct injection injector 5 inject fuel in a condition where the fuel pressure in the GDI fuel tube 3 is high, variation is more likely to occur in the amount of fuel that is actually injected by the direct injection injectors 5. When the direct injection injectors 5 inject fuel in a condition where the fuel pressure in the GDI fuel tube 3 has decreased in this manner, however, the ECM 10 can execute the fuel injection control with a high degree of precision.

After setting the injection amount of the MPI injection performed by the port injectors 4 at zero in the step S4, the injection amount of the MPI injection performed by the port injectors 4 is preferably maintained at zero for a fixed period. In so doing, a situation in which MPI injection is repeatedly executed and stopped with high frequency can be prevented from occurring, and as a result, the fuel injection control can be stabilized. Further, when GDI injection is performed continuously such that the fuel pressure in the GDI tube 3 decreases excessively, the required fuel injection amount can be realized by resuming MPI injection.

Figure 4:
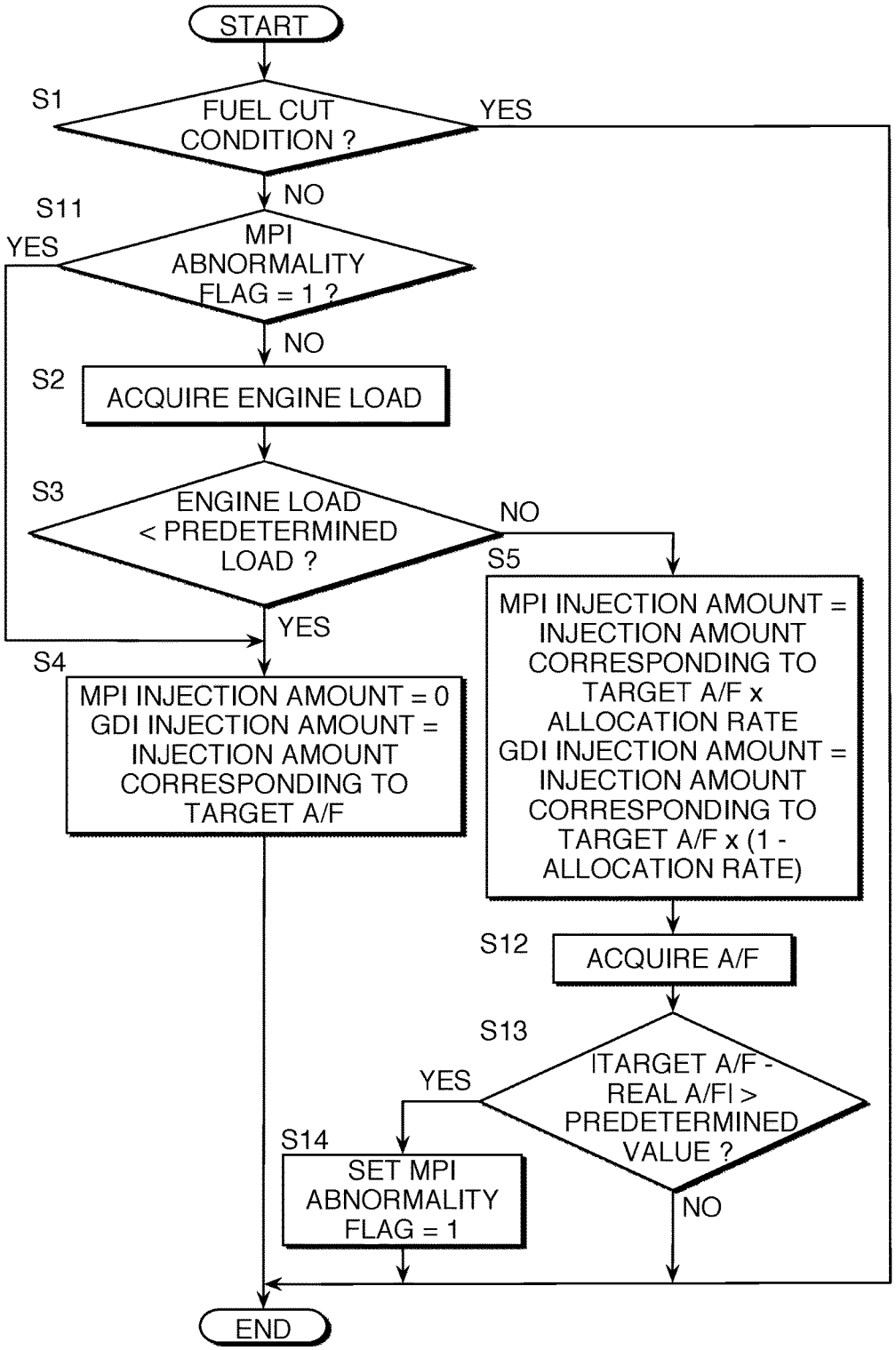
FIG. 4 is a flowchart illustrating a fuel injection control routine executed by an engine control module according to a second embodiment of the present invention.

Next, referring to FIG. 4, a fuel injection control routine according to a second embodiment of the present invention will be described.

In this routine, an abnormality determination process for determining whether or not an abnormality has occurred in the MPI injection performed by the port injectors 4 is added to the fuel injection control routine shown in FIG. 2.

The abnormality determination process is configured as follows. The ECM 10 acquires the air-fuel ratio before and after the determination of the step S3 changes from negative to affirmative on the basis of input signals from the air-fuel ratio sensor 16. When a difference between the air-fuel ratios before and after the determination of the step S3 changes from negative to affirmative equals or exceeds a predetermined value, the ECM 10 determines that an abnormality has occurred in MPI injection by the port injectors 4.

For this purpose, a step S11 is inserted into the fuel injection control routine between the steps S1 and S2 of the fuel injection control routine shown in FIG. 2, and steps S12-S14 are inserted after the step S5.

Before the internal combustion engine enters the low load condition, the determination of the step S3 is negative, and therefore the ECM 10 executes MPI injection and GDI injection at the predetermined allocation rate in the step S5. Following injection at these settings, the ECM 10 acquires an actual air-fuel ratio A/F from an output signal from the air-fuel ratio sensor 16 in the step S12.

Next, in the step S13, the ECM 10 compares an absolute value of a deviation between the predetermined target air-fuel ratio and the actual air-fuel ratio A/F with a predetermined value. Typically, in a dual injection type internal combustion engine, a main injection is performed by means of GDI injection, and MPI injection is performed to compensate for a deficiency occurring when a high output is required. In other words, MPI injection is executed less frequently than GDI injection, and therefore blockages are more likely to occur. The determination of the step S13 is performed to determine whether or not MPI injection is being executed normally.

When the absolute value of the deviation is equal to or smaller than the predetermined value in the step S13, the ECM 10 determines that MPI injection is being performed normally, and therefore terminates the routine.

When the absolute value of the deviation exceeds the predetermined value in the step S13, on the other hand, the ECM 10 determines that MPI injection is not being performed normally, and therefore terminates the routine after setting an MPI abnormality flag at unity in the step S14. It should be noted that an initial value of the MPI abnormality flag is assumed to be zero.

When the routine is next executed, a determination is made in the step S11 as to whether or not the MPI abnormality flag is at unity. When the MPI abnormality flag is not at unity, the processing of the step S2 onward is performed. When the MPI abnormality flag is at unity, the MPI injection amount is set at zero and the GDI injection amount is set to be equal to the target fuel injection amount in the step S4. The reason for this is that when MPI injection by the port injectors 4 is found to be abnormal, fuel injection must be performed by GDI injection alone, irrespective of the load of the internal combustion engine.

With this fuel injection control routine, in addition to the effects brought about by the fuel injection control routine shown in FIG. 2, it is possible to determine whether or not MPI injection is being performed normally by the port injectors 4. Further, when an abnormality occurs in MPI injection, MPI injection by the port injectors 4 is stopped, and the entire fuel injection amount required by the internal combustion engine is supplied by GDI injection. Hence, GDI injection by the direct injection injectors 5 can be utilized to maximum effect even when an abnormality occurs in MPI injection by the port injectors 4, and as a result, deficiencies in the amount of fuel supplied to the internal combustion engine can be minimized.

Furthermore, in this fuel injection control routine, the existence of an abnormality in MPI injection is determined from the difference in the air-fuel ratio A/F. When an abnormality occurs in MPI injection, the air-fuel ratio A/F varies immediately in response thereto. With this determination method, therefore, the occurrence of an abnormality in MPI injection can be detected quickly.

Next, referring to FIG. 5 and FIGS. 6A-6F, a fuel injection control routine according to a third embodiment of the present invention will be described.

In the fuel injection control routines according to the first and second embodiments, the accelerator pedal depression amount is used as the parameter expressing the engine load of the internal combustion engine, and the fuel injection method is switched on the basis of the accelerator pedal depression amount. As described above, however, the fuel injection amount may be used as the engine load of the internal combustion engine. This embodiment illustrates an example thereof.

When the engine load is high, the ECM 10 secures the required fuel injection amount by implementing both GDI injection and MPI injection. When the engine load decreases from the high load condition, the ECM 10 first reduces the MPI injection amount.

The MPI injection amount of the port injectors 4 has a minimum injection amount MPIQmin at which control is possible. Therefore, once the MPI injection amount reaches the minimum injection amount MPIQmin, the ECM 10 reduces the GDI injection amount in accordance with the reduction in the engine load while maintaining the MPI injection amount at the minimum injection amount MPIQmin.

Further, when the required fuel injection amount based on the engine load falls below a maximum injection amount GDIQmax of the GDI injection implemented by the direct injection injectors 5, the ECM 10 stops MPI injection by the port injectors 4, and thereafter supplies the entire required fuel injection amount through GDI injection by the direct injection injectors 5.

A fuel injection control routine executed by the ECM 10 in order to implement the control described above will now be described.

In the step S1, similarly to the first and second embodiments, the ECM 10 determines whether or not the fuel cut condition is established. When the fuel cut condition is established, the routine is terminated. When the fuel cut condition is not established, the ECM 10 determines in the step S21 whether or not the idle switch 17 is ON from an input signal from the idle switch 17.

When the idle switch 17 is not ON, the ECM 10 executes MPI injection and GDI injection at the predetermined allocation rate in a step S28, similarly to the step S5 of the first embodiment, and then terminates the routine. When the idle switch 17 is ON, the ECM 10 calculates the required fuel injection amount from the accelerator pedal depression amount in a step S22.

In a step S23, the ECM 10 determines whether or not the required fuel injection amount is larger than a sum of the maximum injection amount GDIQmax that can be injected by the direct injection injectors 5 and the minimum injection amount MPIQmin that can be injected by the port injectors 4.

When the determination is affirmative, the ECM 10 sets the GDI injection amount of the direct injection injectors 5 to be equal to the maximum injection amount GDIQmax in a step S24. A value obtained by subtracting the maximum injection amount GDIQmax of the direct injection injectors 5 from the required fuel injection amount is set as the MPI injection amount of the port injectors 4. Following the processing of the step S24, the ECM 10 terminates the routine.

When the determination of the step S23 is negative, the ECM 10 determines in a step S25 whether or not the required fuel injection amount is larger than the maximum injection amount GDIQmax that can be injected by the direct injection injectors 5.

When the determination of the step S25 is affirmative, the ECM 10 sets the MPI injection amount of the port injectors 4 at the minimum injection amount MPIQmin in a step S26. A value obtained by subtracting the minimum injection amount MPIQmin from the required fuel injection amount is set as the GDI injection amount of the direct injection injectors 5. Following the processing of the step S26, the ECM 10 terminates the routine.

When the determination of the step S25 is negative, on the other hand, the ECM 10 stops MPI injection by the port injectors 4 in a step S27. The GDI injection amount is then set to be equal to the required fuel injection amount so that the entire required fuel injection amount is supplied through GDI injection by the direct injection injectors 5. Following the processing of the step S27, the ECM 10 terminates the routine.

Figures 6A, 6B, 6C, 6D, 6E, 6F:
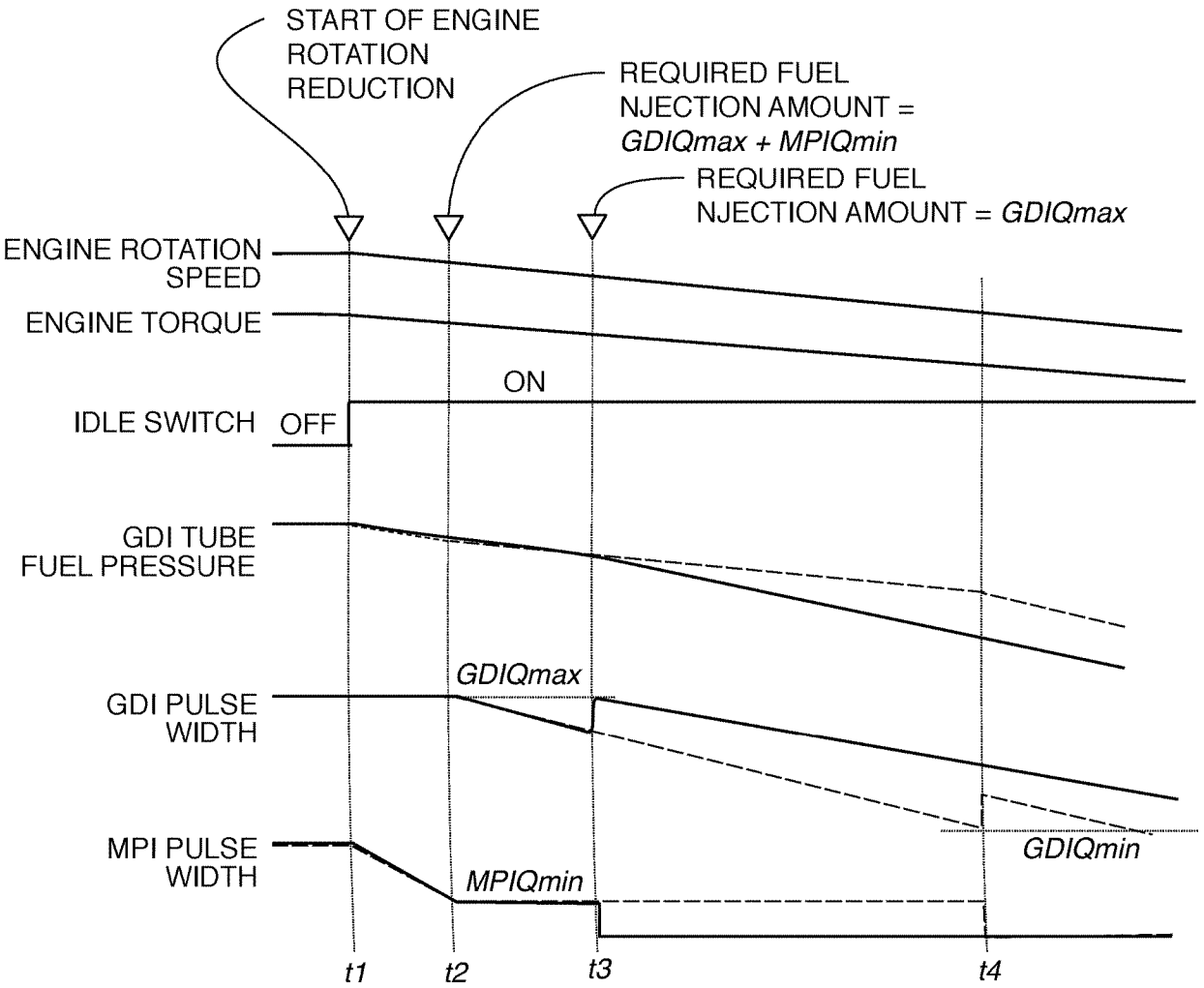
FIGS. 6A-6F are timing charts illustrating execution results of the fuel injection control routine shown in FIG. 5.

Referring to FIGS. 6A-6F, execution results of this fuel injection control routine will be described. This timing chart shows a case in which the accelerator pedal is released while the internal combustion engine is operative at a high load, whereby the idle switch 17 switches ON, as shown in FIG. 6C.

When the idle switch 17 switches from OFF to ON at a time t1, the ECM 10 calculates the required fuel injection amount on the basis of the accelerator pedal depression amount in the step S22. From the time t1 to a time t2, the required fuel injection amount is larger than the sum of the maximum injection amount GDIQmax of the GDI injection and the minimum injection amount MPIQmin of the MPI injection in the step S23. Accordingly, the ECM 10 realizes the required fuel injection amount in the step S24 by maintaining the GDI injection amount at the maximum injection amount GDIQmax, as shown in FIG. 6E, and reducing the MPI injection amount, as shown in FIG. 6F.

From the time t2 onward, the determination of the step S23 is negative. At this stage, the required fuel injection amount is larger than the maximum injection amount GDIQmax of the GDI injection, and therefore the determination of the step S25 is affirmative. Hence, in the step S26, the ECM 10 sets the GDI injection amount at a value obtained by subtracting the minimum injection amount MPIQmin of the MPI injection from the required fuel injection amount while maintaining the MPI injection amount at the minimum injection amount MPIQmin. As a result, from the time t2 onward, the MPI injection amount is maintained at the minimum injection amount MPIQmin, as shown in FIG. 6F, and the GDI injection amount decreases in accordance with the reduction in the required fuel injection amount, as shown in FIG. 6E.

At a time t3, the required fuel injection amount falls to or below the maximum injection amount GDIQmax of the GDI injection. As a result, the determination of the step S25 becomes negative. Hence, in the step S27, the ECM 10 sets the MPI injection amount at zero and supplies the entire required fuel injection amount through GDI injection by the direct injection injectors 5. As a result of this processing, the port injectors 4 stop injecting fuel from the time t3 onward, as shown in FIG. 6F, such that GDI injection by the direct injection injectors 5 is executed alone, as shown in FIG. 6E. Therefore, as shown in FIG. 6D, the pressure in the GDI fuel tube 3 decreases favorably.

At the time t3, MPI injection by the port injectors 4 is stopped, leading to a temporary increase in the GDI injection amount. Thereafter, however, the GDI injection amount decreases in accordance with the reduction in the required fuel injection amount.

Dotted lines in FIGS. 6D-6F show a case in which MPI injection is continued at the minimum injection amount MPIQmin even after the required fuel injection amount falls below the maximum injection amount GDIQmax of the GDI injection. In this case, MPI injection is executed by the port injectors 4 for a long time after the internal combustion engine enters the low load condition. Accordingly, the GDI injection amount of the direct injection injectors 5 is suppressed, and as a result, as shown in FIG. 6D, the fuel pressure in the GDI fuel tube 3 is reduced more slowly by GDI injection. In other words, by executing the fuel injection control routine according to this embodiment, the fuel pressure in the GDI fuel tube 3 can be reduced early.

Figure 5:
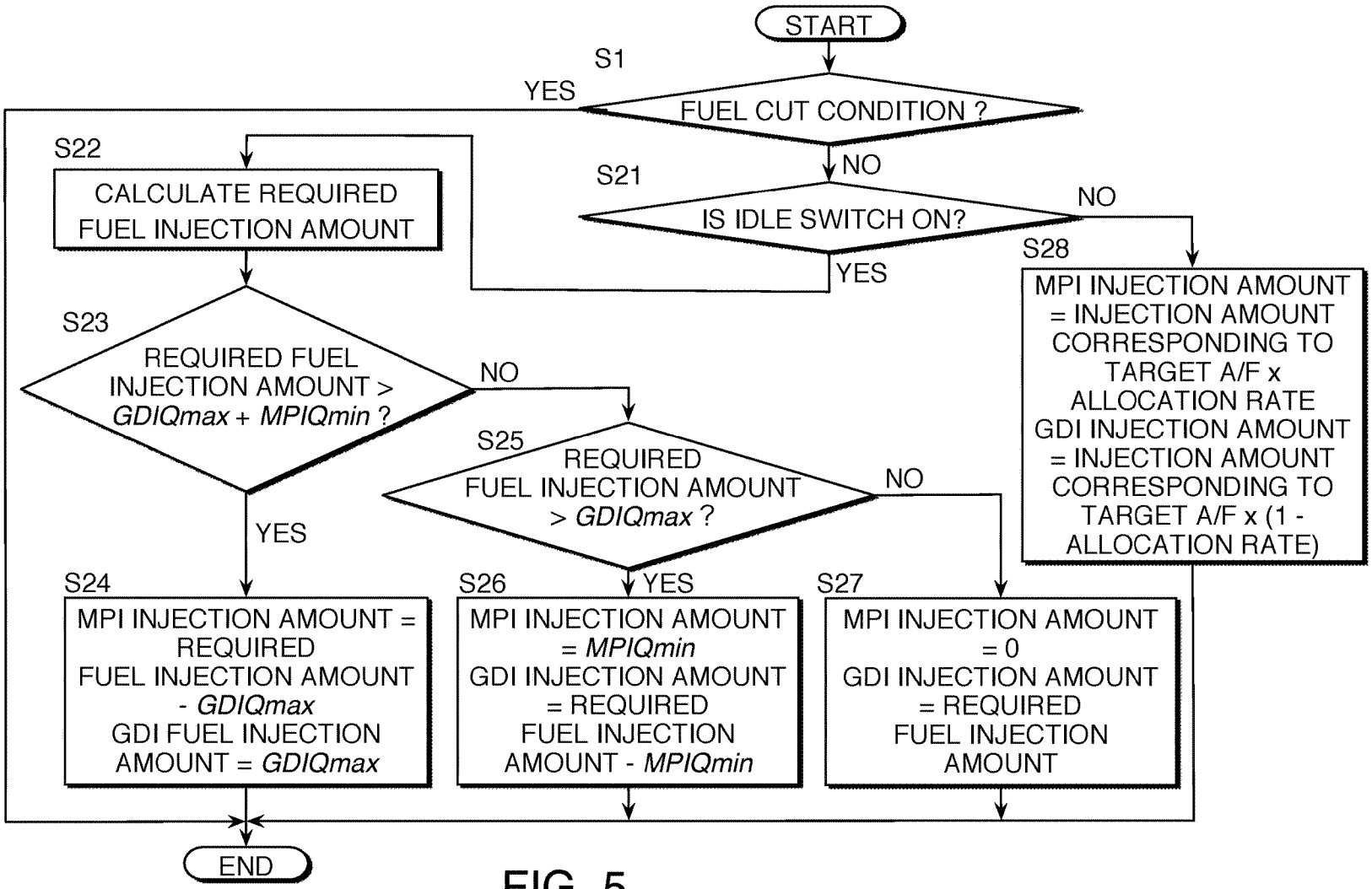
FIG. 5 is a flowchart illustrating a fuel injection control routine executed by an engine control module according to a third embodiment of the present invention.

In this fuel injection control routine, the step S1 of FIG. 5 corresponds to a step for determining whether or not the internal combustion engine requires fuel injection. The step S25 corresponds to a step for determining whether or not the internal combustion engine is being operated in the low load condition. Further, the step S27 corresponds to a step for stopping fuel injection through the port injectors 4 so that the entire fuel injection amount required by the internal combustion engine is injected through the direct injection injectors 5 in a case where the internal combustion engine is in the low load condition while requiring fuel injection.

In each of the embodiments described above, a determination is made as to whether or not the internal combustion engine is being operated in the low load condition, a determination is made as to whether or not the internal combustion engine requires fuel injection, and when the internal combustion engine is in the low load condition while requiring fuel injection, fuel injection through the port injectors 4 is stopped so that the entire fuel injection amount required by the internal combustion engine is injected through the direct injection injectors 5.

In so doing, the fuel pressure in the GDI fuel tube 3 can be reduced early in the low load condition of the internal combustion engine before arriving at the fuel cut condition. Accordingly, the fuel pressure when fuel injection is resumed after fuel injection by the direct injection injectors 5 is stopped, for example, can be suppressed, and as a result, variation in the amount of fuel injected during GDI injection can be suppressed.

Although the invention has been described above with reference to certain embodiments, the invention is not limited to the embodiments described above. Modifications and variations of the embodiments described above will occur to those skilled in the art, within the scope of the claims.

INDUSTRIAL APPLICABILITY

According to the present invention, when a dual injection internal combustion engine having a port injector and a direct injection injector is in a low load condition, the fuel pressure in the direct injection injector can be reduced effectively, enabling an improvement in precision during fuel injection control. Therefore, particularly favorable effects are obtained when the present invention is applied to a high output dual injection internal combustion engine for a vehicle.

The embodiments of this invention in which an exclusive property or privilege is claimed are defined as follows:

1. A fuel injection control device for an internal combustion engine having a port injector that injects fuel into an intake port and a direct injection injector that injects fuel directly into a combustion chamber, the fuel injection control device comprising:

a low-pressure fuel pump capable of supplying fuel to the port injector and the direct injection injector;

a high-pressure fuel pump that further pressurizes the fuel discharged by the low-pressure fuel pump and supplies the pressurized fuel to the direct injection injector;

a load detection sensor that detects a load of the internal combustion engine; and a programmable controller programmed to:

determine whether or not the internal combustion engine operates in a low load condition;

determine whether or not the internal combustion engine requires fuel injection; and when the internal combustion engine operates in the low load condition while requiring fuel injection, perform a determination if a required fuel injection amount is larger than a maximum fuel injection amount of the direct injection injector, stop an operation of the high-pressure fuel pump while causing the direct injection injector to inject the maximum fuel injection amount and causing the port injector to inject fuel corresponding to a difference between the required fuel injection amount and the maximum fuel injection amount using the fuel discharged by the low-pressure fuel pump, when the determination is affirmative, and stop fuel injection through the port injector and stop the operation of the high-pressure fuel pump while causing the direct injection injector to inject the required fuel injection amount using the fuel discharged by the low-pressure fuel pump, when the determination is negative.

2. A fuel injection control method for an internal combustion engine having a port injector that injects fuel into an intake port, a direct injection injector that injects fuel directly into a combustion chamber, a low-pressure fuel pump capable of supplying fuel to the port injector and the direct injection injector, and a high-pressure fuel pump that further pressurizes the fuel discharged by the low-pressure fuel pump and supplies the pressurized fuel to the direct injection injector, the fuel injection control method comprising:

detecting a load of the internal combustion engine;

determining whether or not the internal combustion engine operates in a low load condition;

determining whether or not the internal combustion engine requires fuel injection; and when the internal combustion engine is in the low load condition while requiring fuel injection, performing a determination if a required fuel injection amount is larger than a maximum fuel injection amount of the direct injection injector, stopping an operation of the high-pressure fuel pump while causing the direct injection injector to inject the maximum fuel injection amount and causing the port injector to inject fuel corresponding to a difference between the required fuel injection amount and the maximum fuel injection amount using the fuel discharged by the low-pressure fuel pump, when the determination is affirmative, and stopping fuel injection through the port injector and stopping the operation of the high-pressure fuel pump so that the direct injection injector injects the required fuel injection amount using the fuel discharged by the low-pressure fuel pump, when the determination is negative.

* * * * *